US008878881B2

(12) United States Patent
Li et al.

(10) Patent No.: US 8,878,881 B2
(45) Date of Patent: Nov. 4, 2014

(54) LIQUID CRYSTAL DISPLAY WITH CROSSTALK INTERFERENCE SUPPRESSION BASED ON GRAY-LEVEL VARIATION OF A FRAME TO BE DISPLAYED AND RELATED METHOD

(75) Inventors: Ching-Lin Li, Hsin-Chu (TW); Yi-Fan Lin, Hsin-Chu (TW); Jen-Chieh Chen, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 167 days.

(21) Appl. No.: 13/300,667

(22) Filed: Nov. 21, 2011

(65) Prior Publication Data

US 2012/0293560 A1 Nov. 22, 2012

(30) Foreign Application Priority Data

May 17, 2011 (TW) ..... 100117195 A

(51) Int. Cl.
*G09G 3/36* (2006.01)

(52) U.S. Cl.
CPC ..... *G09G 3/36* (2013.01); *G09G 3/3607* (2013.01)
USPC ..... 345/690; 345/58; 345/94; 345/211; 345/212

(58) Field of Classification Search
CPC ..... G09G 2320/0209; G09G 220/0214; G09G 2320/0219; G09G 2320/0223; G09G 3/3655; G09G 3/3611; G09G 3/3614; G09G 2320/0233; G02B 26/02; G02B 26/004
USPC ..... 345/58, 87–100, 211–213; 382/270
See application file for complete search history.

(56) References Cited

U.S. PATENT DOCUMENTS

| | | | | |
|---|---|---|---|---|
| 5,175,535 | A | 12/1992 | Yamazaki | |
| 2005/0253836 | A1 * | 11/2005 | Kim et al. | 345/212 |
| 2006/0092112 | A1 * | 5/2006 | Moon | 345/87 |
| 2006/0244704 | A1 * | 11/2006 | JaeHun | 345/92 |
| 2008/0278429 | A1 * | 11/2008 | Chen | 345/98 |
| 2008/0278471 | A1 * | 11/2008 | Huang | 345/211 |
| 2008/0303770 | A1 | 12/2008 | Oke | |
| 2009/0015528 | A1 * | 1/2009 | Sheu | 345/87 |
| 2009/0128883 | A1 * | 5/2009 | Endo et al. | 359/290 |
| 2010/0111439 | A1 * | 5/2010 | Fu | 382/270 |
| 2010/0277399 | A1 * | 11/2010 | Yu et al. | 345/58 |

FOREIGN PATENT DOCUMENTS

TW I280555 5/2007

* cited by examiner

*Primary Examiner* — Srilakshmi K Kumar
*Assistant Examiner* — James Nokham
(74) *Attorney, Agent, or Firm* — Winston Hsu; Scott Margo

(57) ABSTRACT

A liquid crystal display having common voltage compensation mechanism includes a liquid-crystal capacitor common electrode for receiving a liquid-crystal capacitor common voltage, a storage capacitor common electrode for receiving a storage capacitor common voltage, a common voltage generator for providing the liquid-crystal capacitor common voltage according to a preliminary common voltage, a common voltage compensation circuit electrically connected to the liquid-crystal capacitor common electrode and the storage capacitor common electrode, and a timing controller electrically connected to the common voltage compensation circuit. The common voltage compensation circuit is utilized for generating the storage capacitor common voltage through performing a ripple inverting operation according to the liquid-crystal capacitor common voltage, the preliminary common voltage and a compensation control signal. The timing controller is employed to analyze an image input signal for generating the compensation control signal.

9 Claims, 4 Drawing Sheets

LIQUID CRYSTAL DISPLAY WITH CROSSTALK INTERFERENCE SUPPRESSION BASED ON GRAY-LEVEL VARIATION OF A FRAME TO BE DISPLAYED AND RELATED METHOD

BACKGROUND

1. Technical Field

The disclosure relates to a liquid crystal display, and more particularly, to a liquid crystal display having common-voltage compensation mechanism and related common-voltage compensation method.

2. Description of the Related Art

Liquid crystal displays (LCDs) have advantages of a thin profile, low power consumption, and low radiation, and are broadly adopted for panel displaying in a variety of electronic products. The operation of a liquid crystal display is featured by modulating the voltage drop across opposite sides of a liquid crystal layer for twisting the angles of liquid crystal molecules in the liquid crystal layer so that the transmittance of the liquid crystal layer can be controlled for illustrating images with the aid of light source provided by a backlight module. It is well known that the polarity of the voltage drop across opposite sides of the liquid crystal layer should be inverted periodically for protecting the liquid crystal layer from causing permanent deterioration due to polarization, and also for avoiding an occurrence of image sticking phenomenon on the LCD screen. Accordingly, various inversion operations, such as frame-inversion driving operations, line-inversion driving operations, pixel-inversion driving operations and dot-inversion driving operations, are developed to drive the liquid crystal display for improving image display performance.

FIG. 1 is a circuit diagram schematically showing a prior-art liquid crystal display 100. As shown in FIG. 1, the liquid crystal display 100 comprises a plurality of data lines 110, a plurality of gate lines 120, a plurality of pixel units 130 and a common voltage generator 190. The data lines 110 include a data line DLi for transmitting a data signal SDi, the gate lines 120 include a gate line GLj for transmitting a gate signal SGj, and the pixel units 130 include a pixel unit Pij having a data switch 135, a liquid-crystal capacitor Clc and a storage capacitor Cst. The data switch 135 is utilized for providing a control of writing the data signal SDi according to the gate signal SGj, thereby generating a desired pixel voltage Vij. The common voltage generator 190 is employed to provide a common voltage Vcom furnished to a common electrode COM. Since parasitic capacitor Cd exists between the data line DLi and the common electrode COM, and since parasitic capacitor Cg exists between the gate line GLj and the common electrode COM, both the voltage changes of the data signal SDi and the gate signal SGj have an effect on the common voltage Vcom at the common electrode COM, which is known as the phenomenon of crosstalk interference occurring to the operation of the liquid crystal display 100. In particular, if adjacent pixel data of a frame to be displayed include lots of black/white gray-level switching pixel data, the aforementioned inversion driving operation of the liquid crystal display 100 is likely to cause serious crosstalk interference, which leads to an occurrence of significant pixel brightness distortion and degrades the display quality on the LCD screen.

SUMMARY

In accordance with an embodiment, a liquid crystal display having common-voltage compensation mechanism is provided. The liquid crystal display comprises a data line for transmitting a data signal, a gate line for transmitting a gate signal, a data switch electrically connected to the data line and the gate line, a liquid-crystal capacitor, a storage capacitor, a common voltage generator electrically connected to the liquid-crystal capacitor, a common-voltage compensation circuit electrically connected to the common voltage generator and the storage capacitor, and a timing controller electrically connected to the common-voltage compensation circuit.

The data switch is utilized for providing a control of writing the data signal according to the gate signal. The liquid-crystal capacitor has a first end electrically connected to the data switch and a second end for receiving a liquid-crystal capacitor common voltage. The storage capacitor has a first end electrically connected to the data switch and a second end for receiving a storage capacitor common voltage. The common voltage generator is employed to provide the liquid-crystal capacitor common voltage according to a preliminary common voltage. The common-voltage compensation circuit is put in use for generating the storage capacitor common voltage through performing a ripple inverting operation according to the liquid-crystal capacitor common voltage, the preliminary common voltage and a compensation control signal. The timing controller is utilized for analyzing an image input signal for generating the compensation control signal.

The present invention further provides a common-voltage compensation method for use in a liquid crystal display having a liquid-crystal capacitor and a storage capacitor. The common-voltage compensation method comprises providing a liquid-crystal capacitor common voltage furnished to the liquid-crystal capacitor according to a preliminary common voltage, generating a preliminary storage capacitor common voltage according to the liquid-crystal capacitor common voltage, performing a high-pass filtering operation on the preliminary storage capacitor common voltage for extracting a first ripple voltage, analyzing an image input signal for generating a compensation control signal, performing an inverting operation on the first ripple voltage based on the preliminary common voltage and the compensation control signal so as to generate a storage capacitor common voltage having a second ripple voltage with a phase opposite to the first ripple voltage, and furnishing the storage capacitor common voltage to the storage capacitor.

These and other objectives of the present invention will no doubt become obvious to those of ordinary skill in the art after reading the following detailed description of the preferred embodiment that is illustrated in the various figures and drawings.

DETAILED DESCRIPTION

Hereinafter, preferred embodiments of the present invention will be described in detail with reference to the accompanying drawings. Here, it is to be noted that the present invention is not limited thereto. Furthermore, the step serial numbers regarding the common-voltage compensation method are not meant thereto limit the operating sequence, and any rearrangement of the operating sequence for achieving same functionality is still within the spirit and scope of the invention.

Figure 1:
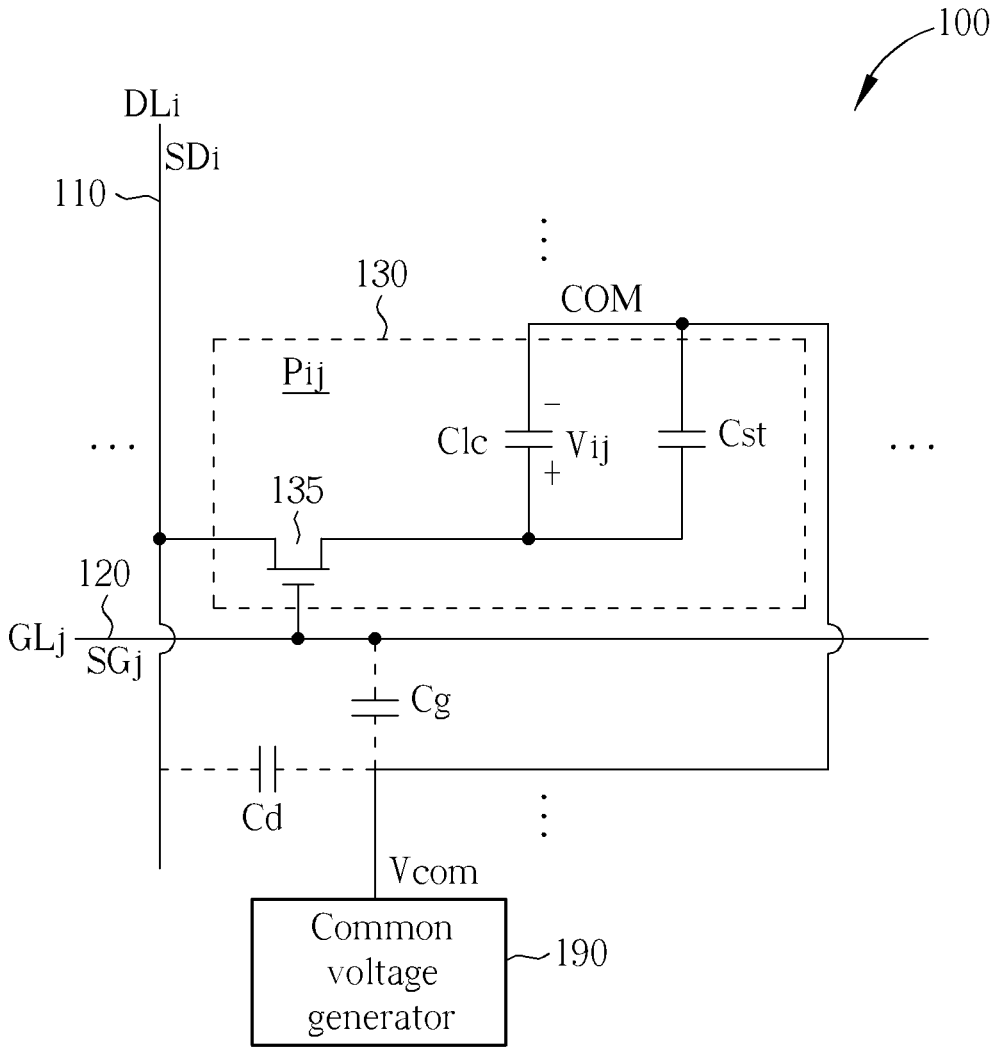
FIG. 1 PRIOR ART
FIG. 1 is a circuit diagram schematically showing a prior-art liquid crystal display.
Figure 2:
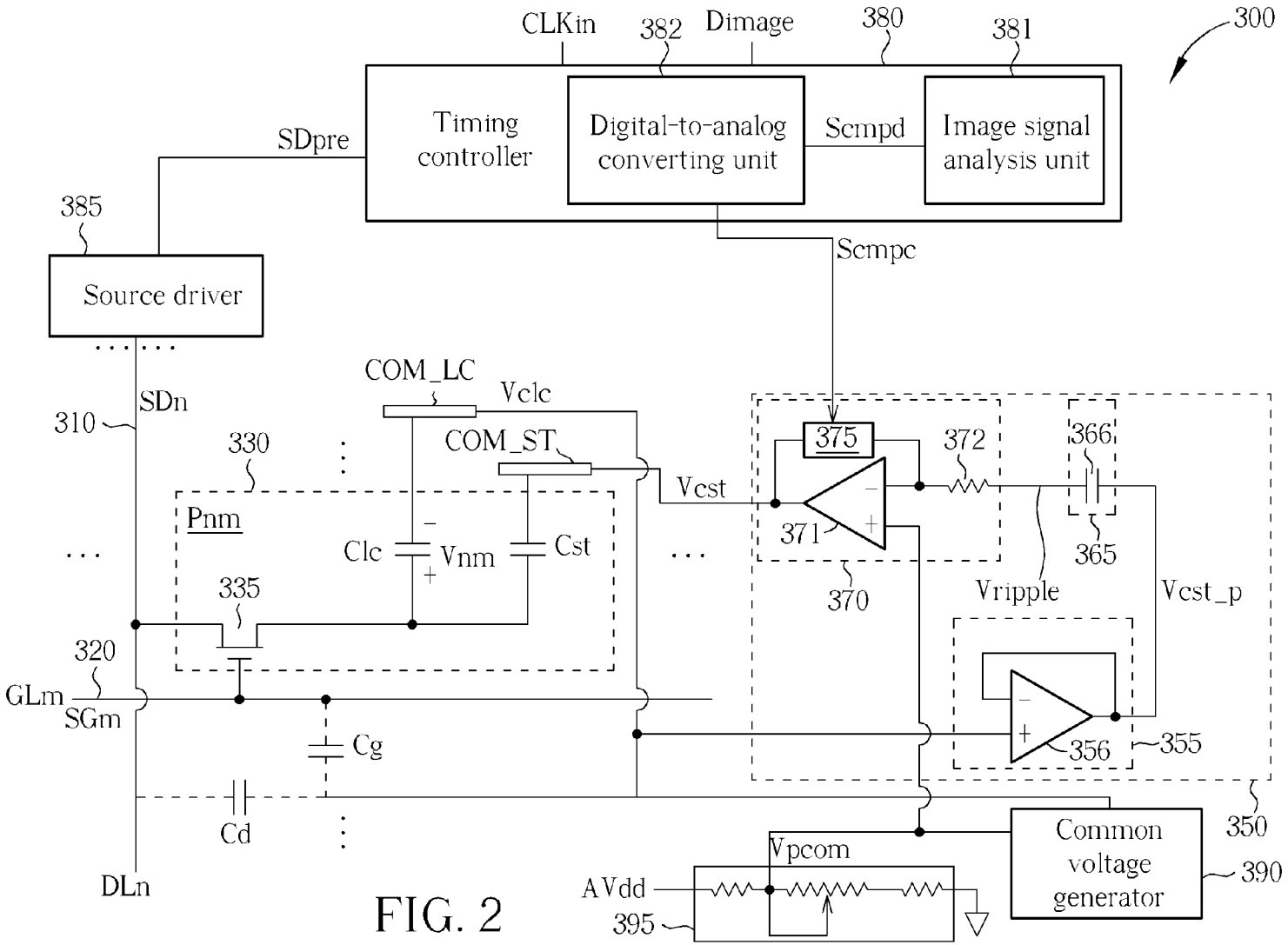
FIG. 2 is a circuit diagram schematically showing a liquid crystal display in accordance with a first embodiment.

FIG. 2 is a circuit diagram schematically showing a liquid crystal display 300 in accordance with a first embodiment. As shown in FIG. 2, the liquid crystal display 300 comprises a plurality of data lines 310, a plurality of gate lines 320, a plurality of pixel units 330, a common-voltage compensation circuit 350, a timing controller 380, a source driver 385, a common voltage generator 390, and a voltage dividing unit 395. The data lines 310 include a data line DLn for transmitting a data signal SDn, the gate lines 320 include a gate line GLm for transmitting a gate signal SGm, and the pixel units 330 include a pixel unit Pnm having a data switch 335, a liquid-crystal capacitor Clc and a storage capacitor Cst. The data switch 335 may be a thin film transistor (TFT), a field effect transistor (FET) or other similar device having connection/disconnection switching functionality. The data switch 335 is utilized for providing a control of writing the data signal SDn according to the gate signal SGm, thereby generating a desired pixel voltage Vnm. The liquid-crystal capacitor Clc is electrically connected between the data switch 335 and a liquid-crystal capacitor common electrode COM_LC. The storage capacitor Cst is electrically connected between the data switch 335 and a storage capacitor common electrode COM_ST.

The timing controller 380 is utilized for generating a preliminary data signal SDpre according to an image input signal Dimage and a clock signal CLKin, such that the source driver 385 is able to provide the data signal SDn furnished to the data line DLn according to the preliminary data signal SDpre. Besides, the timing controller 380 is further employed to analyze the image input signal Dimage for generating a compensation control signal Scmpc furnished to the common-voltage compensation circuit 350. The voltage dividing unit 395 is put in use for performing a voltage dividing operation on a power voltage AVdd so as to generate a preliminary common voltage Vpcom. The common voltage generator 390, electrically connected to the voltage dividing unit 395, is utilized for providing a liquid-crystal capacitor common voltage Vclc furnished to the liquid-crystal capacitor common electrode COM_LC and the common-voltage compensation circuit 350 according to the preliminary common voltage Vpcom.

The common-voltage compensation circuit 350 is utilized for generating a storage capacitor common voltage Vcst furnished to the storage capacitor common electrode COM_ST through performing a ripple inverting operation according to the liquid-crystal capacitor common voltage Vclc, the preliminary common voltage Vpcom and the compensation control signal Scmpc. The common-voltage compensation circuit 350 comprises a buffer 355, a high-pass filter 365, and a ripple-voltage inverter 370. The buffer 355 is utilized for outputting a preliminary storage capacitor common voltage Vcst_p according to the liquid-crystal capacitor common voltage Vclc. The high-pass filter 365, electrically connected between the buffer 355 and the ripple-voltage inverter 370, is employed to perform a high-pass filtering operation on the preliminary storage capacitor common voltage Vcst_p for extracting a first ripple voltage Vripple furnished to the ripple-voltage inverter 370. It is noted that the preliminary storage capacitor common voltage Vcst_p is substantially identical to the liquid-crystal capacitor common voltage Vclc, and therefore the ripple voltage of the liquid-crystal capacitor common voltage Vclc is substantially identical to the first ripple voltage Vripple. The ripple-voltage inverter 370, electrically connected to the voltage dividing unit 395, the high-pass filter 365, the timing controller 380 and the storage capacitor Cst, is put in use for performing an inverting operation on the first ripple voltage Vripple based on the preliminary common voltage Vpcom and the compensation control signal Scmpc so as to generate the storage capacitor common voltage Vcst having a second ripple voltage with a phase opposite to the first ripple voltage Vripple. It is noted that the peak-to-peak value ratio of the second ripple voltage to the first ripple voltage Vripple is set by the ripple-voltage inverter 370 based on the compensation control signal Scmpc.

In the embodiment shown in FIG. 2, the buffer 355 comprises a first operational amplifier 356, the high-pass filter 365 comprises a capacitor 366, the ripple-voltage inverter 370 comprises a second operational amplifier 371, a first resistor 372 and a voltage-controlled resistor unit 375. The first operational amplifier 356 has a non-inverting input end electrically connected to the liquid-crystal capacitor common electrode COM_LC for receiving the liquid-crystal capacitor common voltage Vclc, an output end for outputting the preliminary storage capacitor common voltage Vcst_p, and an inverting input end electrically connected to the output end. The capacitor 366 is electrically connected between the first resistor 372 and the output end of the first operational amplifier 356. The second operational amplifier 371 includes a non-inverting input end electrically connected to the voltage dividing unit 395 for receiving the preliminary common voltage Vpcom, an output end for outputting the storage capacitor common voltage Vcst, and an inverting input end electrically connected to a connection node of the first resistor 372 and the voltage-controlled resistor unit 375.

The first resistor 372 is electrically connected between the capacitor 366 and the inverting input end of the second operational amplifier 371. The voltage-controlled resistor unit 375 is electrically connected between the inverting input end and the output end of the second operational amplifier 371. The voltage-controlled resistor unit 375 is further electrically connected to the timing controller 380 for receiving the compensation control signal Scmpc. The voltage-controlled resistor unit 375 is utilized for controlling resistance between the inverting input end and the output end of the second operational amplifier 371 according to the compensation control signal Scmpc, which in turn controls the peak-to-peak value ratio of the aforementioned second ripple voltage to the first ripple voltage Vripple. That is, the common-voltage compensation circuit 350 controls the peak-to-peak value ratio of the aforementioned second ripple voltage to the first ripple voltage Vripple based on an analog control mechanism.

The timing controller 380 includes an image signal analysis unit 381 and a digital-to-analog converting unit 382. The image signal analysis unit 381 is utilized for analyzing the image input signal Dimage corresponding to a frame to be displayed so as to generate a digital compensation signal Scmpd. The digital-to-analog converting unit 382, electrically connected to the image signal analysis unit 381, is employed to perform a digital-to-analog converting operation on the digital compensation signal Scmpd for generating the compensation control signal Scmpc. In one embodiment, the image signal analysis unit 381 generates a gray-level variation statistical value through analyzing adjacent pixel data of the frame to be displayed, and provides the digital compensation signal Scmpd according to the gray-level variation statistical value. For instance, the image signal analysis unit 381 may be utilized for setting the digital compensation signal Scmpd to be a default value when the gray-level variation statistical value is less than a first predetermined threshold, and for adjusting the digital compensation signal Scmpd in response to the gray-level variation statistical value when the gray-level variation statistical value is not less than the first predetermined threshold. In another embodiment, the image signal analysis unit 381 generates a black/white gray-level switching statistical value through analyzing adjacent pixel data of the frame to be displayed, and provides the digital compensation signal Scmpd according to the black/white gray-level switching statistical value. For instance, the image signal analysis unit 381 may be utilized for setting the digital compensation signal Scmpd to be a default value when the black/white gray-level switching statistical value is less than a second predetermined threshold, and for adjusting the digital compensation signal Scmpd in response to the black/white gray-level switching statistical value when the black/white gray-level switching statistical value is not less than the second predetermined threshold.

In view of that, although the voltage variations of the data signal SDn and the gate signal SGm have an effect on the first ripple voltage Vripple of the liquid-crystal capacitor common voltage Vclc via the parasitic capacitors Cd and Cg, the voltage variation of the liquid-crystal capacitor common voltage Vclc which is caused by crosstalk interference can be compensated by the second ripple voltage of the storage capacitor common voltage Vcst in that the phase of the second ripple voltage is opposite to that of the first ripple voltage Vripple, thereby suppressing the effect of crosstalk interference to improve image display quality. Besides, since the ripple-voltage inverter 370 performs the ripple inverting operation in response to the compensation control signal Scmpc which is generated based on an analysis of the image input signal Dimage, i.e. the aforementioned compensation operation is performed according to the gray-level variation statistical feature of the frame to be displayed, the image display quality of the liquid crystal display 300 is then further improved through effectively suppressing the crosstalk interference caused by the inversion driving operation thereof.

Figure 3:
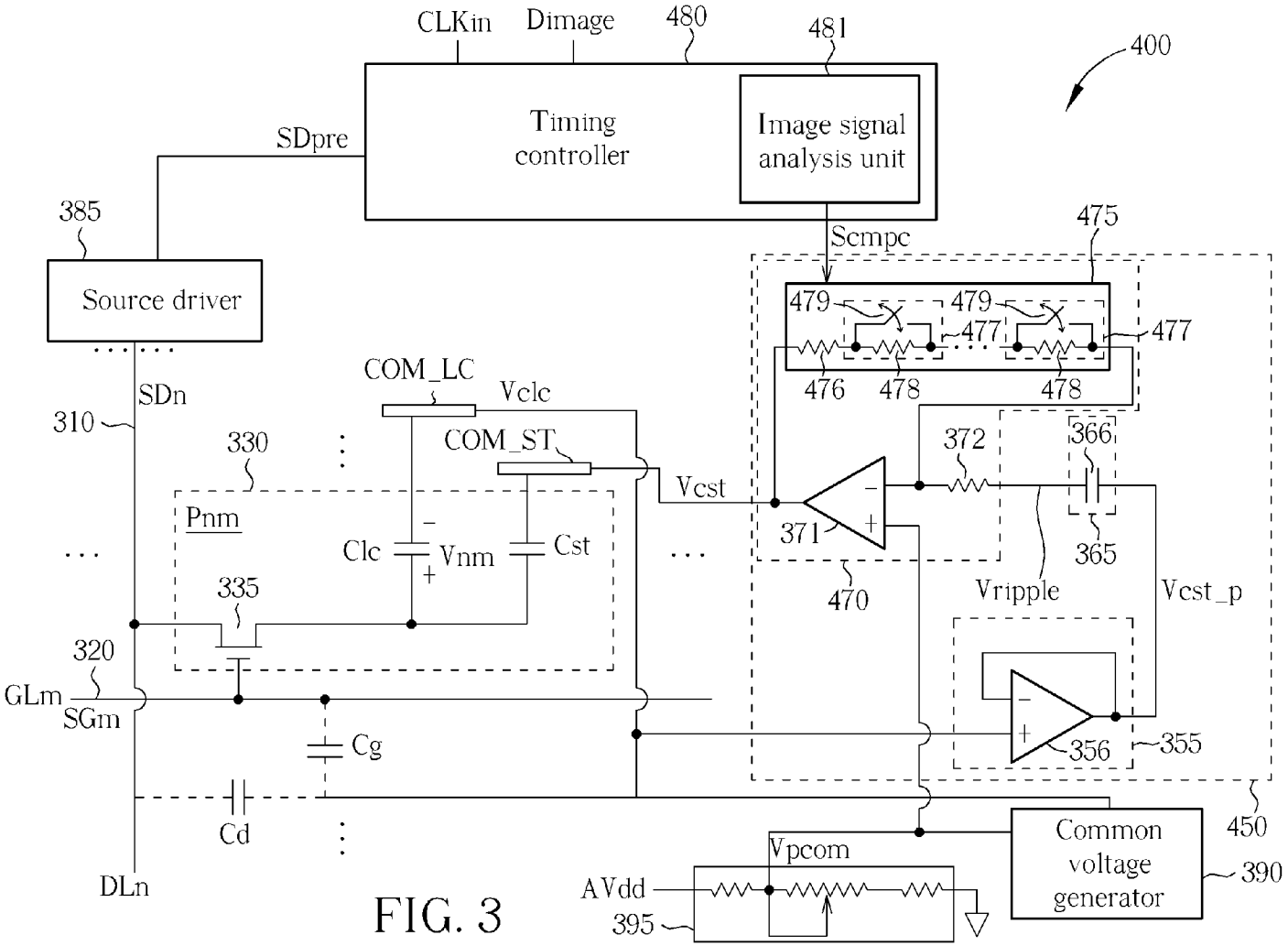
FIG. 3 is a circuit diagram schematically showing a liquid crystal display in accordance with a second embodiment.

FIG. 3 is a circuit diagram schematically showing a liquid crystal display 400 in accordance with a second embodiment. As shown in FIG. 3, the liquid crystal display 400 is similar to the liquid crystal display 300 shown in FIG. 2, differing in that the common-voltage compensation circuit 350 is replaced with a common-voltage compensation circuit 450, and the timing controller 380 is replaced with a timing controller 480. The timing controller 480 is utilized for generating a preliminary data signal SDpre furnished to the source driver 385 according to an image input signal Dimage and a clock signal CLKin. Besides, the timing controller 480 is further employed to analyze the image input signal Dimage for generating a compensation control signal Scmpc with at least one bit which is furnished to the common-voltage compensation circuit 450. That is, the compensation control signal Scmpc shown in FIG. 3 is a digital signal. The common-voltage compensation circuit 450 is utilized for generating a storage capacitor common voltage Vcst furnished to the storage capacitor common electrode COM_ST through performing a ripple inverting operation according to the liquid-crystal capacitor common voltage Vclc, the preliminary common voltage Vpcom and the compensation control signal Scmpc.

The timing controller 480 includes an image signal analysis unit 481 which is utilized for analyzing the image input signal Dimage corresponding to a frame to be displayed so as to generate the compensation control signal Scmpc in digital form. In one embodiment, the image signal analysis unit 481 generates a gray-level variation statistical value through analyzing adjacent pixel data of the frame to be displayed, and provides the compensation control signal Scmpc according to the gray-level variation statistical value. For instance, the image signal analysis unit 481 may be utilized for setting the compensation control signal Scmpc to be a default value when the gray-level variation statistical value is less than a first predetermined threshold, and for adjusting the compensation control signal Scmpc in response to the gray-level variation statistical value when the gray-level variation statistical value is not less than the first predetermined threshold. In another embodiment, the image signal analysis unit 481 generates a black/white gray-level switching statistical value through analyzing adjacent pixel data of the frame to be displayed, and provides the compensation control signal Scmpc according to the black/white gray-level switching statistical value. For instance, the image signal analysis unit 481 may be utilized for setting the compensation control signal Scmpc to be a default value when the black/white gray-level switching statistical value is less than a second predetermined threshold, and for adjusting the compensation control signal Scmpc in response to the black/white gray-level switching statistical value when the black/white gray-level switching statistical value is not less than the second predetermined threshold.

The common-voltage compensation circuit 450 is similar to the common-voltage compensation circuit 350 shown in FIG. 2, differing in that the ripple-voltage inverter 370 is replaced with a ripple-voltage inverter 470. The ripple-voltage inverter 470 comprises the second operational amplifier 371, the first resistor 372 and a resistor switching module 475. The resistor switching module 475 is electrically connected between the inverting input end and the output end of the second operational amplifier 371. The resistor switching module 475 is further electrically connected to the timing controller 480 for receiving the compensation control signal Scmpc. The resistor switching module 475 comprises a second resistor 476 and at least one resistor switching unit 477 which are electrically connected in series.

The resistor switching unit 477 has a third resistor 478 and a switch 479 connected in parallel with the third resistor 478. The conducting/open state of the switch 479 is controlled by the compensation control signal Scmpc, thereby controlling resistance between the inverting input end and the output end of the second operational amplifier 371, which in turn controls the peak-to-peak value ratio of the aforementioned second ripple voltage to the first ripple voltage Vripple. That is, the common-voltage compensation circuit 450 controls the peak-to-peak value ratio of the aforementioned second ripple voltage to the first ripple voltage Vripple based on a digital control mechanism. Other circuit functionalities of the common-voltage compensation circuit 450 are similar to the common-voltage compensation circuit 350 shown in FIG. 2 and can be inferred by analogy. Accordingly, the liquid crystal display 400 is also able to employ the gray-level variation statistical feature of the frame to be displayed for effectively suppressing various crosstalk interferences occurring to the display driving operation thereof, thereby significantly improving image display quality.

Figure 4:
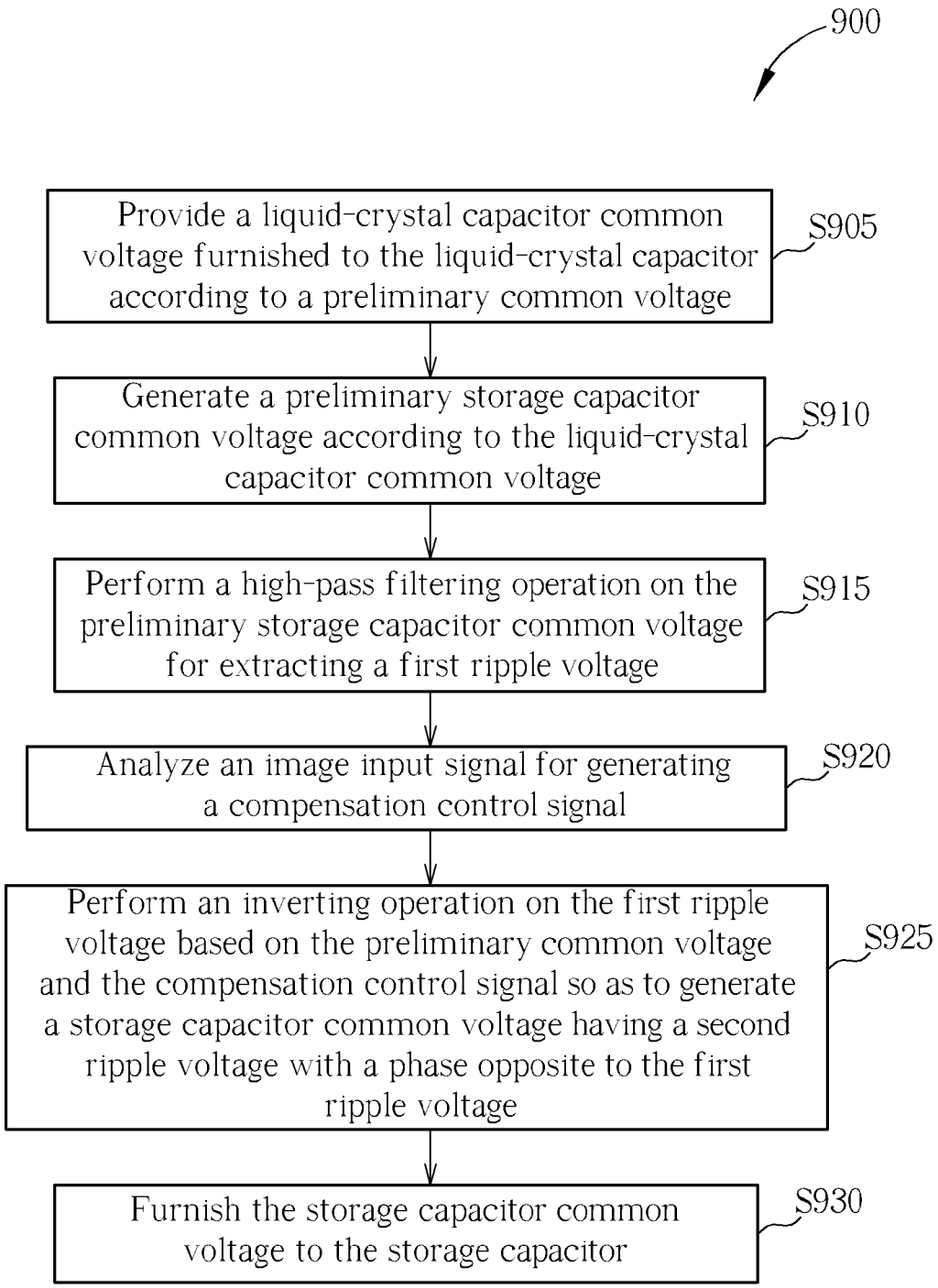
FIG. 4 is a flowchart depicting a common-voltage compensation method for use in a liquid crystal display having a liquid-crystal capacitor and a storage capacitor.

FIG. 4 is a flowchart depicting a common-voltage compensation method for use in a liquid crystal display having a liquid-crystal capacitor and a storage capacitor. As shown in FIG. 4, the flow 900 of the common-voltage compensation method comprises the following steps:

Step S905: providing a liquid-crystal capacitor common voltage furnished to the liquid-crystal capacitor according to a preliminary common voltage;

Step S910: generating a preliminary storage capacitor common voltage according to the liquid-crystal capacitor common voltage;

Step S915: performing a high-pass filtering operation on the preliminary storage capacitor common voltage for extracting a first ripple voltage;

Step S920: analyzing an image input signal for generating a compensation control signal;

Step S925: performing an inverting operation on the first ripple voltage based on the preliminary common voltage and the compensation control signal so as to generate a storage capacitor common voltage having a second ripple voltage with a phase opposite to the first ripple voltage; and Step S930: furnishing the storage capacitor common voltage to the storage capacitor.

Regarding the flow 900 of the common-voltage compensation method described above, the peak-to-peak value ratio of the second ripple voltage to the first ripple voltage is determined according to the compensation control signal. In one embodiment, the step S920 may comprise analyzing the image input signal for generating a digital compensation signal and performing a digital-to-analog converting operation on the digital compensation signal for generating the compensation control signal. In another embodiment, the step S920 may comprise analyzing the image input signal for generating the compensation control signal with at least one bit. Besides, the step S920 may comprise analyzing the image input signal corresponding to a frame to be displayed so as to generate the compensation control signal, e.g. generating a gray-level variation statistical value through analyzing adjacent pixel data of the frame to be displayed and providing the compensation control signal according to the gray-level variation statistical value. The gray-level variation statistical value may be a black/white gray-level switching statistical value. The aforementioned process of providing the compensation control signal according to the gray-level variation statistical value may comprise setting the compensation control signal to be a default value when the gray-level variation statistical value is less than a predetermined threshold, and adjusting the compensation control signal in response to the gray-level variation statistical value when the gray-level variation statistical value is not less than the predetermined threshold. In view of that, the common-voltage compensation method is able to employ the gray-level variation statistical feature of the frame to be displayed for effectively suppressing various crosstalk interferences occurring to the display driving operation of the liquid crystal display, thereby significantly improving image display quality.

In conclusion, the common-voltage compensation mechanism of the liquid crystal display according to the present invention is able to effectively suppress various crosstalk interferences occurring to the display driving operation thereof based on the gray-level variation statistical feature of the frame to be displayed, for significantly improving image display quality.

The present invention is by no means limited to the embodiments as described above by referring to the accompanying drawings, which may be modified and altered in a variety of different ways without departing from the scope of the present invention. Thus, it should be understood by those skilled in the art that various modifications, combinations, sub-combinations and alternations might occur depending on design requirements and other factors insofar as they are within the scope of the appended claims or the equivalents thereof.

What is claimed is:

1. A liquid crystal display, comprising:

a data line for transmitting a data signal;

a gate line for transmitting a gate signal;

a data switch, electrically connected to the data line and the gate line, for providing a control of writing the data signal according to the gate signal;

a liquid-crystal capacitor having a first end electrically connected to the data switch and a second end for receiving a liquid-crystal capacitor common voltage;

a storage capacitor having a first end electrically connected to the data switch and a second end for receiving a storage capacitor common voltage;

a common voltage generator, electrically connected to the liquid-crystal capacitor, for providing the liquid-crystal capacitor common voltage according to a preliminary common voltage;

a common-voltage compensation circuit, electrically connected to the common voltage generator and the storage capacitor, for generating the storage capacitor common voltage through performing a ripple inverting operation according to the liquid-crystal capacitor common voltage, the preliminary common voltage and a compensation control signal; and a timing controller, electrically connected to the common-voltage compensation circuit, for analyzing an image input signal so as to generate the compensation control signal, wherein the timing controller comprises:

an image signal analysis unit for analyzing the image input signal corresponding to only a frame to be currently displayed so as to generate a digital compensation signal, wherein the image signal analysis unit is utilized for generating a gray-level variation statistical value through analyzing adjacent pixel data of the frame to be displayed, and for providing the digital compensation signal according to the gray-level variation statistical value, the image signal analysis unit outputting the digital compensation signal having a default value when the gray-level variation statistical value is less than a threshold, and the image signal analysis unit adjusting the digital compensation signal in response to the gray-level variation statistical value when the gray-level variation statistical value is not less than the threshold; and a digital-to-analog converting unit, electrically connected to the image signal analysis unit, for performing a digital-to-analog converting operation on the digital compensation signal for generating the compensation control signal.

2. The liquid crystal display of claim 1, wherein the common-voltage compensation circuit comprises:

a buffer, electrically connected to the common voltage generator, for outputting a preliminary storage capacitor common voltage according to the liquid-crystal capacitor common voltage;

a high-pass filter, electrically connected to the buffer, for performing a high-pass filtering operation on the preliminary storage capacitor common voltage for extracting a first ripple voltage; and a ripple-voltage inverter, electrically connected to the timing controller, the high-pass filter and the storage capacitor, for performing an inverting operation on the first ripple voltage based on the preliminary common voltage and the compensation control signal so as to generate the storage capacitor common voltage having a second ripple voltage with a phase opposite to the first ripple voltage.

3. The liquid crystal display of claim 2, wherein the ripple-voltage inverter sets a peak-to-peak value ratio of the second ripple voltage to the first ripple voltage according to the compensation control signal.

4. The liquid crystal display of claim 2, wherein the buffer comprises an operational amplifier, the operational amplifier comprising:

a non-inverting input end, electrically connected to the common voltage generator, for receiving the liquid-crystal capacitor common voltage;

an output end, electrically connected to the high-pass filter, for outputting the preliminary storage capacitor common voltage; and an inverting input end electrically connected to the output end.

5. The liquid crystal display of claim 2, wherein the high-pass filter comprises a capacitor electrically connected between the buffer and the ripple-voltage inverter.

6. The liquid crystal display of claim 2, wherein the ripple-voltage inverter comprises:

an operational amplifier comprising a non-inverting input end for receiving the preliminary common voltage, an output end for outputting the storage capacitor common voltage, and an inverting input end;

a first resistor electrically connected between the high-pass filter and the inverting input end of the operational amplifier; and a voltage-controlled resistor unit, electrically connected between the inverting input end and the output end of the operational amplifier and electrically connected to the timing controller for receiving the compensation control signal, for controlling resistance between the inverting input end and the output end of the operational amplifier according to the compensation control signal.

7. The liquid crystal display of claim 1, further comprising:

a voltage dividing unit, electrically connected to the common-voltage compensation circuit and the common voltage generator, for performing a voltage dividing operation on a power voltage so as to generate the preliminary common voltage.

8. A common-voltage compensation method for use in a liquid crystal display having a liquid-crystal capacitor and a storage capacitor, the common-voltage compensation method comprising:

providing a liquid-crystal capacitor common voltage furnished to the liquid-crystal capacitor according to a preliminary common voltage;

generating a preliminary storage capacitor common voltage according to the liquid-crystal capacitor common voltage;

performing a high-pass filtering operation on the preliminary storage capacitor common voltage for extracting a first ripple voltage;

analyzing an image input signal corresponding to only a frame to be currently displayed for generating a compensation control signal, comprising:

generating a gray-level variation statistical value through analyzing adjacent pixel data of the frame to be displayed; and providing the compensation control signal according to the gray-level variation statistical value, comprising:

setting the compensation control signal to be a default value when the gray-level variation statistical value is less than a threshold; and adjusting the compensation control signal in response to the gray-level variation statistical value when the gray-level variation statistical value is not less than the threshold;

performing an inverting operation on the first ripple voltage based on the preliminary common voltage and the compensation control signal so as to generate a storage capacitor common voltage having a second ripple voltage with a phase opposite to the first ripple voltage; and furnishing the storage capacitor common voltage to the storage capacitor.

9. The common-voltage compensation method of claim 8, wherein the step of performing the inverting operation on the first ripple voltage based on the preliminary common voltage and the compensation control signal so as to generate the storage capacitor common voltage having the second ripple voltage with a phase opposite to the first ripple voltage comprises:

setting a peak-to-peak value ratio of the second ripple voltage to the first ripple voltage according to the compensation control signal.

* * * * *